United States Patent [19]

Fink

[11] 4,393,104

[45] Jul. 12, 1983

[54] TABLE PLACEMAT

[75] Inventor: Helen M. Fink, 8 Indian Dawn, Wayland, Mass. 01778

[73] Assignee: Helen M. Fink, Hastings-on-Hudson, N.Y.

[21] Appl. No.: 264,705

[22] Filed: May 18, 1981

[51] Int. Cl.[3] ..... A47G 23/00; B65D 65/02

[52] U.S. Cl. ..... 428/7; D6/271; 428/68; 428/187; 428/542.2

[58] Field of Search ..... D6/271; 428/68, 81, 428/7, 77, 187, 542.2, 542.4, 542.8; 206/453, 457; 248/346.1, 451

[56] References Cited

U.S. PATENT DOCUMENTS

| | | | |
|---|---|---|---|
| 875,076 | 12/1907 | Hinman | 428/81 |
| 2,043,321 | 6/1936 | Fleischer | 428/5 X |
| 2,721,818 | 10/1955 | Dolnick et al. | 428/68 |
| 2,757,854 | 8/1956 | Wall | 206/453 X |
| 2,806,313 | 9/1957 | James | 428/5 |
| 2,983,069 | 5/1961 | Birney et al. | 428/7 X |
| 3,041,774 | 7/1962 | Walker | 248/451 |
| 3,095,967 | 7/1963 | Harvey, Jr. | 206/457 X |
| 3,295,577 | 1/1967 | Danielson | 428/100 X |
| 3,310,091 | 3/1967 | Geisen et al. | 428/100 X |
| 3,517,407 | 6/1970 | Wyant | 428/121 X |
| 3,920,870 | 11/1975 | Ackerman et al. | 428/46 |
| 3,983,277 | 9/1976 | Ackerman et al. | 428/46 |
| 4,137,356 | 1/1979 | Shoemaker et al. | 428/178 X |
| 4,238,070 | 12/1980 | Lyons | 428/7 X |

*Primary Examiner*—Henry F. Epstein
*Attorney, Agent, or Firm*—Herbert L. Bello

[57] ABSTRACT

A placemat of the type used for organizing a table setting, the placemat having a cover which is removably attached over a rigid support member. In a preferred embodiment, the rigid support member is formed of a wood material and in a substantially rectangular configuration. The cover is formed of a flexible material, such as a fabric, and is provided with an elastic material along its perimeter to maintain the cover in position around the rigid support member. At least one further cover having a predetermined graphic aspect is provided around the cover. The graphical aspect of the cover and the partial cover may be advantageously selected to have a predetermined significance, thereby eliminating the need for separate placemats for different occasions and holidays.

7 Claims, 3 Drawing Figures

TABLE PLACEMAT

BACKGROUND OF THE INVENTION

This invention relates generally to placemats of the type used in setting a table, and more particularly, to a rigid placemat adaptable for use with a plurality of covers, the covers being indicative of selectable occasions, places of business, or particular individuals or groups of persons.

Conventional table placements are known to be formed of either flexible or rigid materials. Known flexible table placemats are formed of cloth, flexible plastic, or woven wood. Cloth table placemats must be washed often, causing them to shrink and deform, thereby requiring such cloth placemats to be ironed or pressed after washing. The need for such ironing or pressing increases the labor and energy costs associated with the use of cloth placemats.

Although table placemats formed of flexible plastic materials are easy to clean, such placemats are generally not used in formal environments. In addition, the ornamentation or visual aspect of the plastic placemat is fixed in the material, thereby limiting the adaptability of such placemat for special occasions, or to identify businesses or persons.

A further type of flexible placemat is formed of woven strips of flexible wood, in the form of a basket-weave. Flexible wooden placemats are difficult to store, difficult to clean, and subject to deformation after repeated use or improper storage. In addition, the ornamental aspect of such placemats is not adaptable to specialized uses, as described with respect to the plastic placemats.

The prior art has thrust at the problem of placemat deformation by providing rigid placemats which may be formed of metal, wood, or rigid plastic. Generally, the visual aspect of such rigid placemats is fixed, thereby requiring many such rigid placemats to be purchased and stored if adaptability of the visual aspect of the placemats to particular occasions is desired. Thus, occasion-specialized or personalized placemats are prohibitively expensive to purchase and store, particularly for large restaurants, or residences with limited storage space.

It is, therefore, an object of this invention to provide an improved placemat having an advantageously adjustable visual aspect.

It is a further object of this invention to provide a placemat which is rigid and has a cloth, or cloth-like, covering so as to be suitable for formal eating environments.

It is another object of this invention to provide a rigid placemat having a cover which is easily removed for laundering.

It is a still further object of this invention to provide a rigid placemat arrangement which requires a relatively rigid base member for use in conjunction with a relatively large number of covering materials having the desired visual aspects.

SUMMARY OF THE INVENTION

The foregoing and other objects are achieved by this invention which provides a placemat of the type used for organizing a table setting, the placemat having a rigid support member which defines a predetermined shape of the placemat. The rigid support member may be formed of a substantially flat and rigid material having a predetermined thickness, which is covered by a first removable cover which is fitted over the rigid support member. The first removable cover is formed of a flexible material having a surface area greater than the surface area of one side of the rigid support member, thereby permitting the first removable cover to completely cover one surface of the rigid support member, and wrap around partially over the other surface. The placemat may be provided with a second cover of a complementary design which covers only a predetermined portion of the surface of the placemat so as to form an overall visual aspect having a predetermined significance.

In one embodiment of the invention, the rigid support member is formed of a wooden material, such as masonite, the wooden material having a substantially rectangular shape. In addition to the second cover, the placemat may be provided with a third cover which covers only a predetermined portion of the first cover. The third cover may be arranged in a predetermined relationship, such as either orthogonal to or parallel with the second cover, so as to form a desired visual aspect.

In a preferred embodiment of the invention, the first cover is held in position around the rigid support member by an elastomeric material which is arranged along an edge of the first cover. Similarly, the optional second and third covers may also be provided with an elastic material which holds them in position around the rigid support member. Alternative means, such as hook and loop fasteners, or snap fasteners, may be provided to hold the second and third covers in position with respect to the second cover. Also, the rigid support member may have any desired shape, such as that of a circle, oval, or polygon.

BRIEF DESCRIPTION OF THE DRAWINGS

Comprehension of the invention is facilitated by reading the following detailed description in conjunction with the annexed drawings, in which.

DETAILED DESCRIPTION

Figure 1:
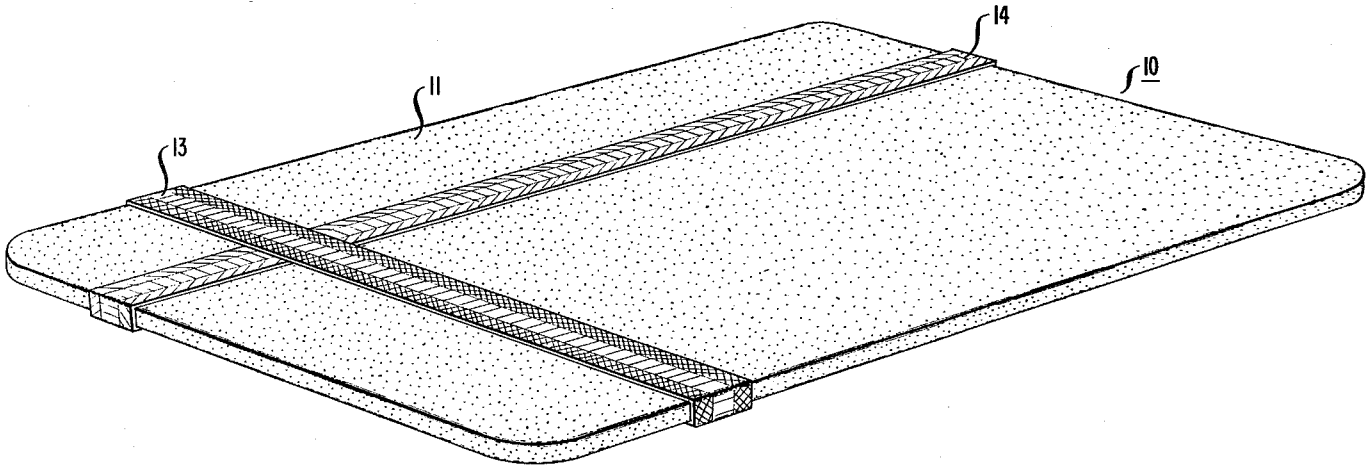
FIG. 1 is a perspective view of a top surface of an embodiment of the invention.

FIG. 1 shows a placemat 10 having a rigid support member (not visible in this figure) covered by a cover 11 on a top surface. In this embodiment, placemat 10 has a substantially rectangular shape with rounded corners. Cover 11, which is the first of several covers, is formed of a flexible material in the form of a fabric which possesses a degree of elasticity. The fabric may thus be either knitted or woven and be possessive of a sufficient degree of stretching to allow for a relatively tight fit over the rigid support member.

In this embodiment, placemat 10 is provided with partial or overlying covers 13 and 14. As shown, partial cover 13 extends along the shorter side of the rectangular configuration of placemat 10. Partial cover 14 is arranged orthogonal to partial cover 13, so as to extend along the longer dimension of the placemat.

Partial covers 13 and 14 are provided with a predetermined graphical aspect, which may be stripes having coordinated or complementary designs, as shown. Alternatively, the partial covers may have embroidered or printed thereon symbols or lettering indicative of a particular occasion, holiday, business or individual or group of persons. The graphical aspect of partial cover 13 and 14 may be coordinated with an optional design (not shown) which may be embroidered or printed on cover 11. In any event, partial covers overlying the base cover are to be of coordinated or complementary designs with one another.

Figure 2:
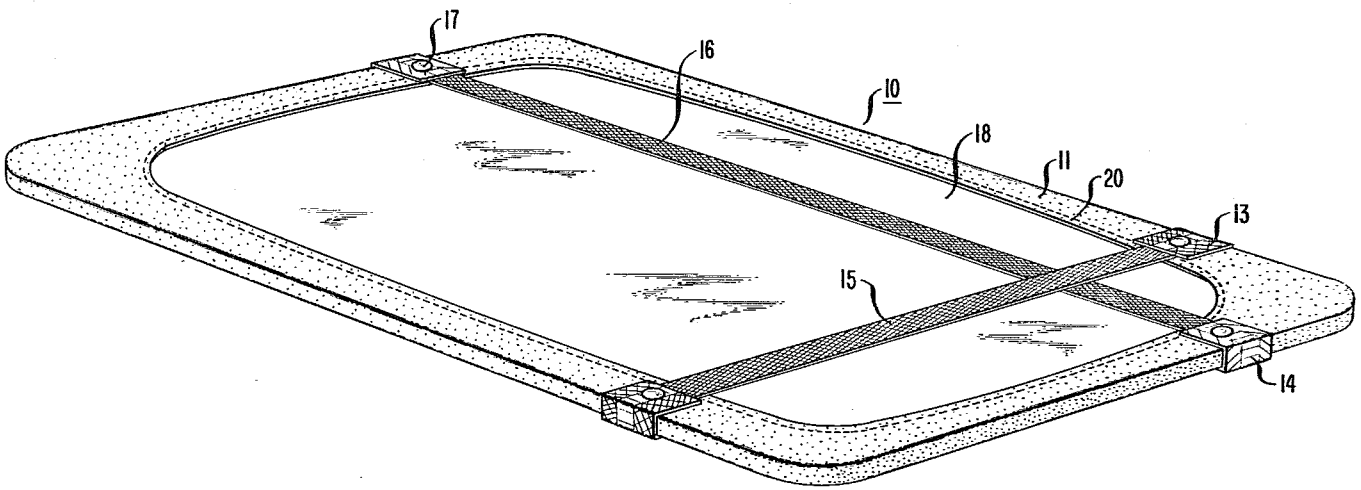
FIG. 2 is a perspective view of the underside of the embodiment of FIG. 1.

FIG. 2 shows a perspective view of the underside of placemat 10. This figure shows partial covers 13 and 14 to be provided with respective sections 15 and 16 of elastic material. The portions of elastic material are coupled to their respective partial covers by any known method, including fasteners 17.

FIG. 2 further shows cover 11 to be wrapped around rigid support member 18. Cover 11 is provided with an elastic band 20 which is sewn along the perimeter of cover 11. Elastic band 20 maintains cover 11 tautly drawn over rigid support member 18.

As previously noted, rigid support member 18 may be formed of a wood material such as masonite. Alternatively, the rigid support member may be formed of a plastic, cardboard, metallic, or any other rigid material, in any desired shape.

Figure 3:
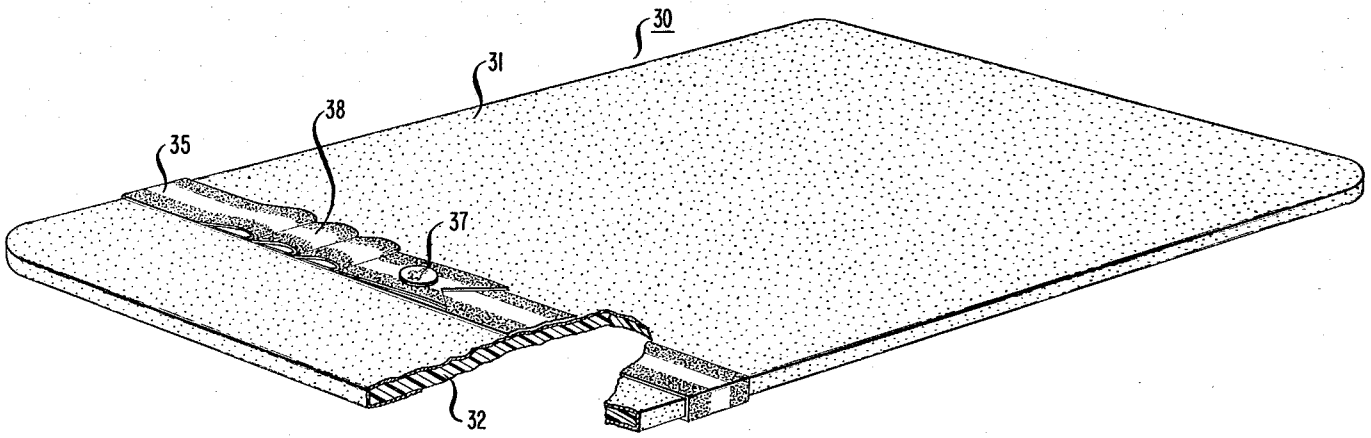
FIG. 3 is a partially-fragmented, perspective view of an embodiment of the invention showing the layered structure of the placemat.

FIG. 3 shows an embodiment of a placemat 30 which is provided with a cover 31 arranged over a rigid support member 32, as discussed above. The placemat is provided with a partial cover 35, which, in this embodiment, is provided with a medallion 37 and pleats 38. Partial cover 35 is provided with a graphic design indicative of a national holiday. Thus, an operator of a commercial eating establishment, such as a restaurant, need not purchase and store many placemats decorated for one holiday, such as the 4th of July. Instead, the restaurant operator purchases and stores only a sufficient number of partial covers 35, resulting in a substantial savings.

Although the inventive concept has been disclosed in terms of specific embodiments and applications, it is to be understood that persons skilled in the art can generate additional embodiments without departing from the scope of the invention. Accordingly, the drawings and descriptions in this disclosure should be viewed in an illustrative, and not limiting sense.

What is claimed is:

1. A placemat of a type placed on a tabletop for organizing a table setting, the placemat comprising:

rigid support means for defining a predetermined shape of the placemat, said rigid support means being formed of a substantially flat, rigid material having a perdetermined thickness and respective first and second surfaces arranged parallel to the tabletop, said first surface facing away from the tabletop and having a predetermined surface area, said second surface facing toward the tabletop;

first cover means removable attached to said rigid support means, said first cover means being formed of a flexible material having a surface area greater than said predetermined surface area of said first surface of said rigid support means, said first cover means being arranged over said first surface of said rigid support means so as to have an extending portion of said first cover means which extends beyond said predetermined shape of the placemat, said extending portion of said first cover means being drawn around said predetermined thickness of said rigid support means so as to cover at least partially said second surface of said rigid support means, said extending portion thereby being interposed between said rigid support means and the tabletop when the placemat is placed thereon;

first cover holding means on said extending portion of said first cover means for maintaining said extending portion over said second surface of said rigid support means;

second cover means removably arranged over a predetermined portion of said first cover means, said second cover means being formed of a flexible material having a graphical pattern thereon, said graphical pattern having a selectable one of a perdetermined significance and a complementary coordinated design with that of said first cover; and second cover holding means formed of an elastomeric material for applying a tensile force to said second cover means and thereby holding said second cover means over said predetermined portion of said first cover means, said second cover holding means being arranged to be interposed between said rigid support means and the tabletop when the placemat is placed thereon.

2. The placemat of claim 1 wherein said rigid support means is formed of a wood material, said predetermined shape of the placemat being substantially rectangular.

3. The placemat of claim 1 wherein there is a further provided third cover means removably arranged over a further predetermined portion of said first cover means, said third cover means being arranged in a predetermined angular relationship with said second cover means.

4. The placemat of claim 3 wherein said third cover means is arranged transverse with respect to said second cover means.

5. The placemat of claim 1 wherein said third cover means is arranged substantially parallel to said second cover means.

6. The placemat of claim 1 wherein said, first cover holding means comprises an elastomeric material arranged along an edge of said first cover means.

7. The placemat of claim 1 wherein said rigid support means is formed of a rigid material, said predetermined shape of the placemat being substantially oval in form.

* * * * *